US006547895B2

(12) United States Patent
Bradley et al.

(10) Patent No.: US 6,547,895 B2
(45) Date of Patent: Apr. 15, 2003

(54) SUPERPLASTIC MULTI-LAYER FORMING

(75) Inventors: John Robert Bradley, Clarkston, MI (US); John E. Carsley, St. Clair Shores, MI (US); Jacob Lyjak, Washington Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/768,541

(22) Filed: Jan. 25, 2001

(65) Prior Publication Data

US 2002/0134470 A1 Sep. 26, 2002

(51) Int. Cl.[7] ..... C22F 1/04

(52) U.S. Cl. ..... 148/535; 148/564; 72/363; 72/709

(58) Field of Search ..... 148/527, 535, 148/564; 72/363, 709

(56) References Cited

U.S. PATENT DOCUMENTS

| | | | | | |
|---|---|---|---|---|---|
| 4,479,293 | A | * | 10/1984 | Miller et al. | 148/564 |
| 4,820,355 | A | * | 4/1989 | Bampton | 148/564 |
| 4,984,732 | A | * | 1/1991 | Hudson et al. | 72/709 |
| 5,115,963 | A | | 5/1992 | Yasui | 228/157 |
| 5,135,582 | A | * | 8/1992 | Mochizuki et al. | 148/564 |
| 5,330,092 | A | * | 7/1994 | Gregg et al. | 72/709 |
| 5,413,271 | A | | 5/1995 | Mansbridge et al. | 228/157 |

* cited by examiner

*Primary Examiner*—George Wyszomierski

(57) ABSTRACT

The superplastic forming of suitable metal alloy sheets into strong components, such as automobile body structures or panels, is improved and accomplished faster by simultaneously forming two or more substantially identical, relatively thin sheets, preferably about 2 mm or less in thickness, rather than a single sheet of the same overall thickness. For example, two or more layers of thin AA5083 sheets can be stretched formed together at about 500° C. with greater deformation and elongation than a single sheet of comparable thickness.

4 Claims, 2 Drawing Sheets

SUPERPLASTIC MULTI-LAYER FORMING

TECHNICAL FIELD

This invention pertains to a method of forming relatively thick sheet metal products from superplastic sheet metal stock. More specifically, this invention pertains to a practical and rapid stretch forming method of forming such products using a plurality of relatively thin sheets of suitably deformable starting material.

BACKGROUND OF THE INVENTION

Most automobile body panels are made by shaping low carbon steel or aluminum alloy sheet stock into body and panel shapes. The number of sheet metal pieces that must be formed and welded or otherwise attached together to form the vehicle body depends upon the design shape of the parts and the formability of the sheet metal. It is desirable, both from the viewpoint of manufacturing cost and fit and integrity of the assembled structural panels, to make the body from as few parts as possible. Other manufacturing operations are likewise affected by the complexity of a product shape that can be formed from the starting sheet metal. Thus, there is always an incentive to devise more formable metal alloys and better forming processes so that relatively few parts of more complex shape can be made and joined to make a car body or other product rather than joining a myriad of smaller, simpler pieces.

Superplastic titanium and aluminum sheet metal alloys have been identified and their use explored in the manufacturing of sheet metal products, especially those of complex configuration. Superplastic titanium alloys have been described for use in aerospace structures. The relatively high cost of titanium alloys and their slow superplastic forming cycles may be acceptable in aeronautical applications in order to save weight. Other industries usually look to less expensive alloys, such as aluminum alloys, for major component applications. Such industries also seek high productivity sheet metal forming processes.

Some investigations of superplastic aluminum alloys for automotive and boat applications have been undertaken. A common practice is to secure a sheet of the material at its periphery, heat it to a superplastic forming temperature, and apply gas pressure to one side to stretch the sheet against a forming tool. This is known as stretch forming. But difficulties have been encountered both in dealing with slow forming cycles and a typical substantial decrease in formability of sheets much thicker than about two millimeters (mm). It is observed the formability of superplastic sheet metal alloy stock often decreases significantly as thickness of the sheet increases over about 2 mm or so. The forming times are quite long and the sheet tears in regions of high elongation. The strength requirements of automotive body sections and the like may require thicker sections of complex configuration. The art has not found a practical way for superplastic aluminum alloys to be used in such applications.

SUMMARY OF THE INVENTION

This invention is based on the discovery that two or more relatively thin sheets of certain superplastic aluminum alloys can be stacked and stretch formed together. If desired, the two sheets can be formed without diffusion bonding between them. It was found that two identical layered thin sheets of a suitable magnesium-containing aluminum alloy could readily be formed with greater deformation or elongation than a single sheet of comparable thickness. In other words, it is possible and practical to form, by superplastic forming, preferably stretch forming, a more complex product shape (in the sense of degree of elongation or deformation) using two or more thin superplastic metal layers to obtain the strength of a unitary thick piece.

This practice is applicable, for example, to the family of known alloys of aluminum, titanium and other metals in which superplastic properties are attributed an extremely fine grain (usually less than 10 to 15 $\mu$m) microstructure which appears at relatively low magnification as a pseudo-single phase microstructure. The actual microstructures comprise a phase of the principal element, such as Ti or Al, with a distributed precipitate phase. The superplastic properties of such metal alloy sheets are usually imparted by a process comprising casting, hot rolling and severe cold working to a specified sheet thickness followed by thermally-induced recrystallization to form the very fine grains in the cold worked material.

A particularly useful application of the invention is with superplastic magnesium-containing aluminum alloys, like AA5083, because of the need for relatively thick section, light weight automotive structures. Aluminum Alloy 5083 has a typical nominal composition, by weight, of about 4% to 5% magnesium, 0.3% to 1% manganese, a maximum of 0.25% chromium, about 0.1% copper, up to about 0.3% iron, up to about 0.2% silicon, and the balance substantially all aluminum. Generally, the alloy is first hot and then cold rolled to a thickness from about one to about four millimeters. In the AA5083 alloys, the microstructure is characterized by a principal phase of a solid solution of magnesium in aluminum with well-distributed, finely dispersed particles of intermetallic compounds containing the minor alloying constituents, such as $Al_6Mn$.

In accordance with the invention, it has been repeatedly demonstrated that two 1.5 mm thick AA5083 sheets can be laid over each other congruently and stretch formed at 500° C. with greater defect-free deformation and elongation than a single 3.0 mm thick sheet of the same composition and nominal thermomechanical processing history. Often, the two thinner sheets could be successfully formed more rapidly than the single sheet of equivalent total thickness. Typically, the two or more sheets, which may be identical or not, are formed together but are not diffusion bonded by the forming process. However, the sheets may be clamped, spot welded or the like, before superplastic forming to simplify handling.

After superplastic forming, the sheets may be permanently attached in any suitable manner, such as by welding, to form a unitary part. Alternatively, the formed sheet layers can be separated for usage as independent parts. Or two similar sheets can be separated, one inverted and the pair attached at their edges to form a symmetrical box configuration or a channel member. In other embodiments, one or more formed layers may be used as reinforcement sections over portions of a main part layer.

Other objects and advantages of the invention will become more apparent from a description of specific embodiments which follow.

DESCRIPTION OF THE PREFERRED EMBODIMENT

Figure 1:
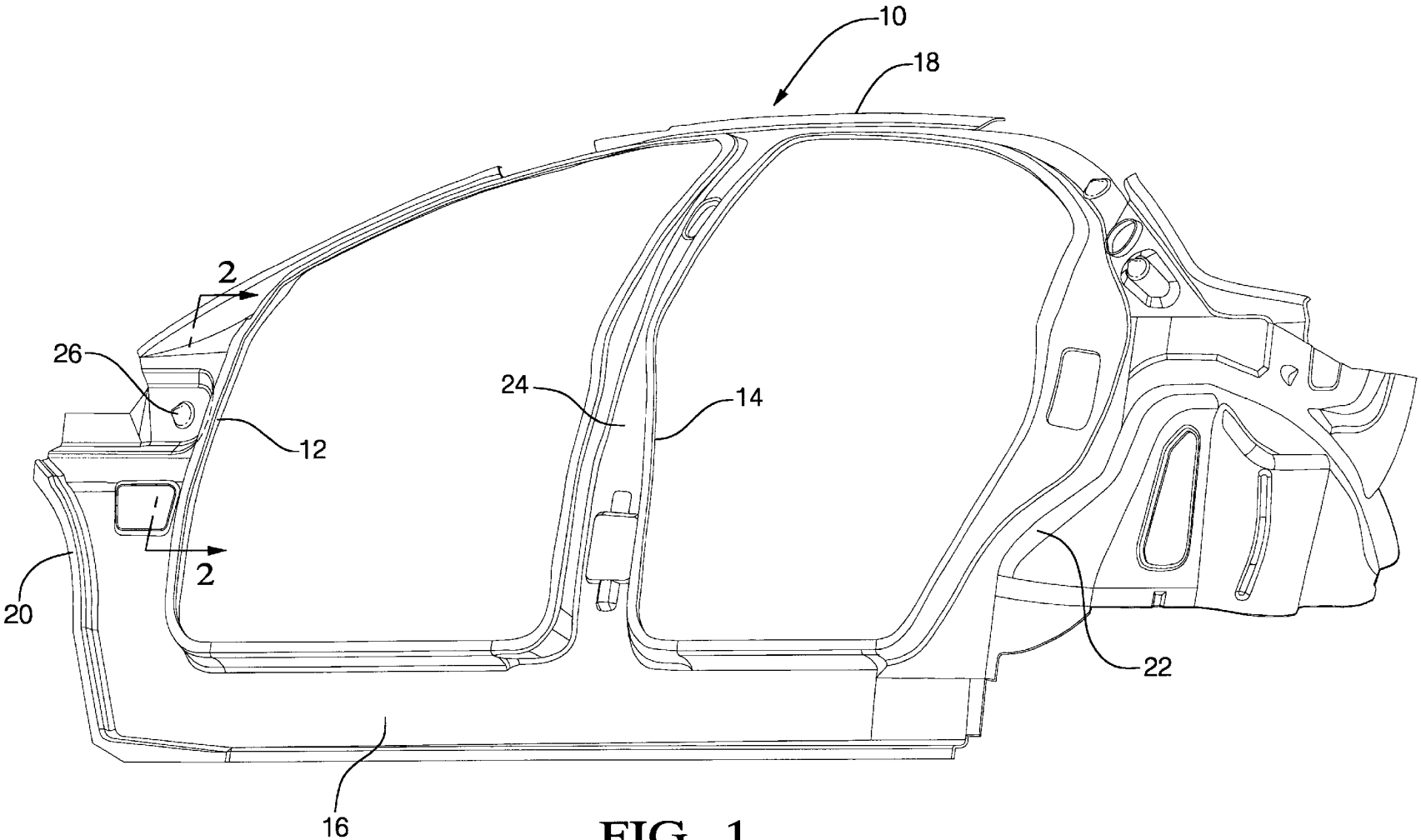
FIG. 1 is an isometric view of an automotive body sideframe panel of complex curvature and shape that was formed simultaneously of two identical sheets of 1.5 mm thick AA5083 material.

The invention will be described with reference to the use of AA5083 alloys in a process in which two or more relatively thin alloy sheets are stacked on top of each other and then formed simultaneously using suitable superplastic forming techniques. Stretch forming is preferred. A number of possible uses and advantages of such superplastic multi-layer forming are described.

Imparting superplastic properties to aluminum sheet, such as AA5083, begins during the casting and thermomechanical processing of the alloy at the mill. The thermomechanical processing involves a combination of hot and cold rolling to obtain the final sheet gauge with the necessary amount of cold work. Thus, the critical superplastic forming properties of the repeatedly rolled product result from a process with inherent manufacturing variation.

The amount of cold reduction possible by conventional rolling methods is limited by, among other things, the maximum thickness at which the supplier can coil the hot band material prior to cold rolling; the thicker the hot band, the more cold reduction is possible. A high percentage of cold reduction in the final sheet thickness causes a very high level of strain energy to be stored in the material. That strain energy is the thermodynamic driving force for recrystallization. The nucleation rate for recrystallized grains increases rapidly with increasing the strain energy stored in the material. Therefore, upon reheating, a heavily cold rolled sheet can recrystallize to an extremely fine-grained structure. Under superplastic forming conditions, the fine grain size results in a low flow stress, high strain rate sensitivity and resistance to necking. It has been found that AA5083 aluminum alloy sheets processed with about 75% or more cold reduction recrystallize to a grain size of about 8 $\mu$m which is small enough for superplastic deformation.

This amount of cold reduction corresponds to a finished sheet thickness of about 2 mm or less for the sheets currently provided by some manufacturers. However, sheets cold rolled to a final thickness greater than about 2 mm have less stored strain energy and, accordingly, recrystallize to a larger grained structure. A strain gradient also exists in the thickness direction of heavier gauge sheets. The strain gradient results in a recrystallized grain size gradient, i.e., coarser grains in the middle of the sheet than at the surface. The general result is that thicker sheet has a higher flow stress at superplastic forming conditions and thus a more limited ability to deform superplastically. Thus, aluminum alloy components of a thickness greater than about 2 mm can be difficult to form superplastically. However, it has now been found that superplastic multi-layer stretch forming (at a suitable elevated temperature under gas pressure) can overcome that difficulty. A thick part that is otherwise difficult to superplastically form can be fabricated by multi-layer forming two substantially identical, thinner, more formable sheets. If they have not previously been attached for handling, the two fully-formed thin pieces can then be assembled, by welding, for example, into a single component.

Some superplastically-formed components benefit from local increases in thickness in order to optimize mass while meeting all of their performance criteria. Local reinforcements, in the form of small sheet metal patches that conform to the shape of the primary panel, are formed by carefully locating the patch blanks between the parent sheet and the tool surface. A single part may require several such reinforcement patches, and some patches are much thicker than can be formed superplastically. A set of two or more thin reinforcement patches could be stacked and formed simultaneously by superplastic multi-layer forming in a situation where a single, thicker patch was difficult or impossible to form. Furthermore, accurate and secure positioning of the small patch pieces can be extremely difficult. Superplastically multi-layer forming two full size blanks, possibly of different gauges, and then cutting the patches from the second sheet produces reinforcements with perfect placement and conformity to the parent sheet.

Superplastically-formed aluminum alloy sheet develops internal cavities, or micro-porosity. The amount of cavitation increases exponentially with the amount of deformation strain. Cavitation can become excessive when the strain exceeds a threshold level of about 45% thinning. Application of gas pressure to the tool side of the blank as it deforms reduces cavitation. Similarly, multi-layer forming may, in some cases, reduce cavitation in the gas-side sheet of the pair if the tool side sheet, i.e., the sheet not directly exposed to the forming gas, provides a sufficient backpressure.

A productivity increase may also be realized if sets of thin-gauge parts, designed with multi-layer forming in mind, can be formed simultaneously as nested pairs. For example, a box-section rail could be produced by simultaneously forming two channels as a nested pair. The channels could then be joined along their flange surfaces to produce the rail.

Finally, since the gas-side sheet of a doubly formed pair is formed in contact with a second sheet of aluminum, as opposed to the surface of the die, it may exhibit improved surface quality.

The forming trials described below illustrate some of the potential advantages of superplastic multi-layer forming.

1. Multi-Layered Domes:

Three sets of double-layer domes were superplastically formed in a 400 mm diameter hemispherical bulge tool by simultaneously stretch forming two superimposed, identical blanks of 1.5 mm thick 5083 alloy, without lubricant, at 500° C. into the cylindrical die cavity. Each forming condition produced a pair of domes that were easily separated.

Formation of these double domes under a constant gas pressure of 0.30 MPa (44 psi) was interrupted at three different stages: after 540, 600, and 665 seconds. In each case, a single dome was also formed under the same conditions from 3.0 mm thick sheet. Superplastic tensile elongation of the 1.5 mm material tested at 500° C. and at a strain rate of $10^{-3}s^{-1}$ was in the range of 326% to 350% whereas the tensile elongation of the 3.0 mm sheet was only in the range of 251% to 300%. Each forming test was intended to stretch the sheet or sheets to determine the forming characteristics of the metal short of the point of failure.

The dome heights and pole location thicknesses are presented in Table 1. In each case, the heights of the multi-layer formed 1.5 mm domes were significantly greater than the height of the corresponding single 3.0 mm dome.

TABLE 1

Multi-layer formed 1.5 mm blanks vs. single 3.0 mm blanks

| Blank Thickness | Forming Time | Dome Height | Pole Thickness |
|---|---|---|---|
| 3.0 mm | 665 sec. | 98.8 mm | 1.07 mm |
| 1.5 mm (inner) | 665 sec. | 106.0 mm | 0.51 mm |
| 1.5 mm (outer) | 665 sec. | 106.3 mm | 0.51 mm |
| 3.0 mm | 600 sec. | 78.0 mm | 1.55 mm |
| 1.5 mm (inner) | 600 sec. | 91.0 mm | 0.63 mm |
| 1.5 mm (outer) | 600 sec. | 93.9 mm | 0.61 mm |
| 3.0 mm | 540 sec. | 72.9 mm | 1.68 mm |
| 1.5 mm (inner) | 540 sec. | 82.6 mm | 0.76 mm |
| 1.5 mm (outer) | 540 sec. | 83.7 mm | 0.76 mm |

In each of the three superplastic stretch forming comparison tests, the pair of 1.5 mm thick sheets made a higher and thinner dome than the single sheet of 3 mm thick material of the same composition. Thus, the two sheets can be expected to form more severely deformed parts than a single sheet of equivalent thickness.

Figure 2:
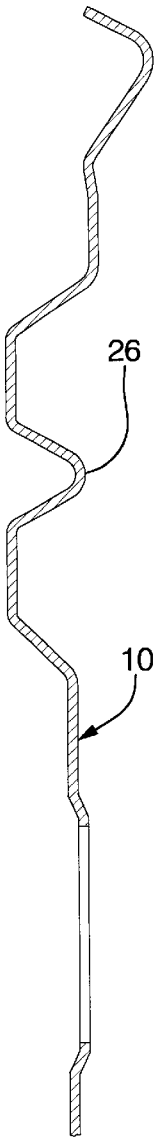
FIG. 2 is a cross-sectional view of a deep formed conical portion of the sideframe of FIG. 1 viewed in the direction 2—2 indicated in that figure.

2. Multi-Layer Auto Body Sideframe Inner Panels:

A one-piece, superplastically-formed, automobile sideframe inner panel represents an opportunity for consolidation of ten or more conventional stampings into a single component. Such a panel is illustrated in isometric view in FIG. 1. The panel 10 has the shape of the curvature of the vehicle and the large number of shape details of the many functions it serves. In this example, the single piece sideframe panel 10 includes front door frame 12, rear door frame 14, a lower rocker portion 16 for a welded connection to one or more floor pans, a roof portion 18 for a welded attachment of a roof panel, and front 20 and rear 22 portions for attachment of wheel enclosures and fenders. The single piece 10 may also accommodate additional cross body support members. The B pillar region 24 between the door frames provides a vertical support function and provides anchorage for a seat belt and the like. While the whole single piece sideframe 10 is of complex three-dimensional configuration, an exceptionally highly strained region is the deeply stretched, locating cone 26, also illustrated in FIG. 2.

The sideframe design 10 typically requires a relatively heavy, e.g., 3.5 mm gauge, blank when formed of AA5083 to satisfy strength requirements. However, the 3.5 mm thick material proved difficult to form in initial trials to stretch form the shape of FIG. 1 with deeply stretched regions including that at cone 26 of the panel region shown in FIG. 2.

In a first trial, AA5083 aluminum sheet of 3.5 mm thickness was employed. The material had 12 $\mu$m average grain size. The rectangular forming blank had dimensions of 57"×106". The blank was lubricated with boron nitride, a superior stretch-forming lubricant, on both sides. The blank was placed on a forming tool in the configuration of the sideframe panel and secured at its peripheral surfaces. The platen temperature was controlled at 582° C. The sheet blank was preheated for about ten minutes to a temperature of about 520° C. Air (the working gas in this trial) pressure was increased in accordance with the schedule in the following table to a final forming pressure of 300 psi. The total forming time was about 45 minutes but the sheet ruptured in the region of cone 26 during the forming operation.

| Set point no. | 1 | 2 | 3 | 4 | 5 | 6 | 7 | 8 | 9 | 10 |
|---|---|---|---|---|---|---|---|---|---|---|
| Time, min. | 6 | 12 | 15 | 19 | 22 | 25 | 28 | 31 | 34 | 45 |
| Pressure, psi | 15 | 25 | 35 | 50 | 100 | 150 | 200 | 250 | 300 | 300 |

After the failed attempt to stretch form the 3.5 mm thick sheet, the multi-layer forming concept was tested by attempting the forming of two, 1.5 mm sheets in place of the single thick blank (no 1.75 mm sheet stock being on hand). It was hoped that each of the thinner sheets would be more formable because they had experienced more cold working than the 3.5 mm sheet stock. The two 1.5 mm thick blanks were of AA5083 aluminum, 10 $\mu$m average grain size, 57"×106" and lubricated with boron nitride on both sides. The sheets were spot welded at several spots around their periphery so that the two blanks could be handled as a single unit.

The processing conditions including the pressure schedule were the same as those set forth above for the 3.5 mm thick sheet. The platen temperature was 582° C. and the sheet was preheated to about 520° C. during a ten minute preheat time. The sideframe was fully formed from the pair of 1.5 mm thick blanks, with no problems or tears in either sheet. However, the forming time of 45 minutes is excessive. Accordingly, the forming test with two identical 1.5 mm sheets was repeated on the same tooling and with the same thermal processing. However, a significantly shorter forming cycle was imposed. The pressure was increased much more rapidly, over a period of only 20 minutes, increased to the same maximum nitrogen gas-forming pressure of about 300 psi in accordance with the schedule in the following table.

| Setpoint no. | 1 | 2 | 3 | 4 | 5 | 6 | 7 | 8 |
|---|---|---|---|---|---|---|---|---|
| Time, minutes | 5 | 8 | 9 | 10 | 12 | 14 | 16 | 20 |
| Pressure, psi | 15 | 30 | 45 | 66 | 150 | 240 | 300 | 300 |

In the test a small tear was seen in one sheet. Although no further attempt was made to optimize the forming cycle, it was apparent the two thin sheets could be satisfactorily formed significantly faster than the 45 minutes required to form the 3.5 mm thick sheet.

Figure 3:
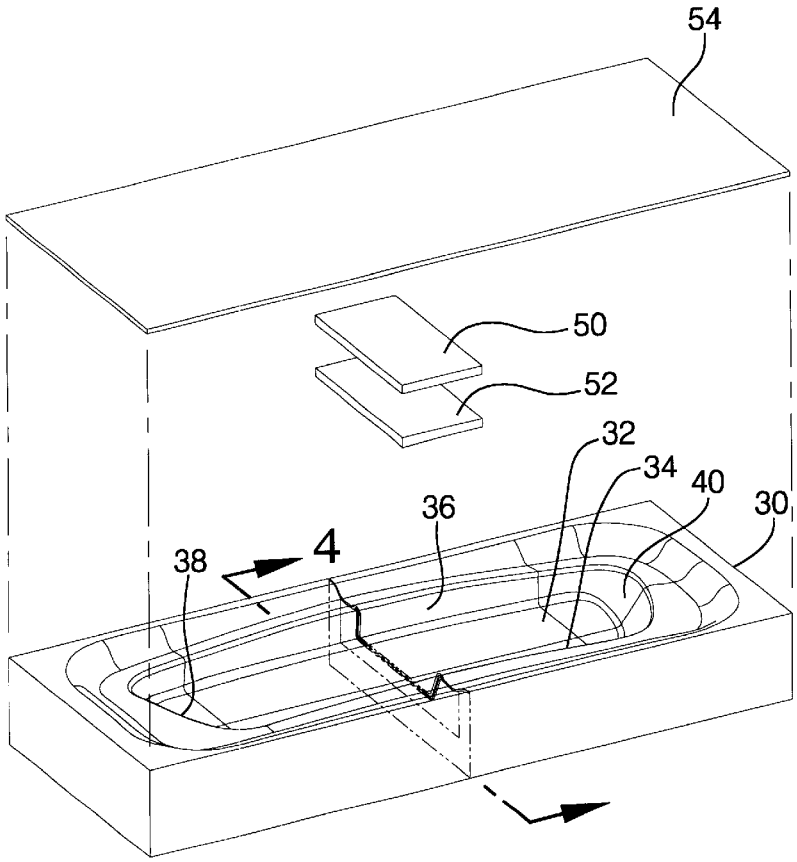
FIG. 3 is an isometric view of a forming tool for a deep drawn pocket-shaped article. Overlying the tool are a sheet of SPF aluminum alloy and two reinforcement sheet blanks of the same alloy that are to be SPF stretch formed simultaneously in the tool.

3. Multi-layer Formed Patches:

Multi-layer formed patches were made from aluminum alloy 5083 sheet by forming two, 2.5 mm thick patches spanning the license plate pocket area of a 3.5 mm thick panel formed in an experimental die. Referring to FIG. 3, a stretch forming tool 30 is used for forming a representative deeply stretched or drawn pocket such as a license plate pocket in an automobile deck lid. The pocket region 32 in the tool 30 is seen to have substantially vertical sides 34 and 36 and ends 38 and 40. Seen above the tool 30, ready for SPF stretch forming, are the full-size license plate pocket blank 54 and two underlying patch pieces 50 and 52. The three sheet metal layers 54, 50 and 52 had a combined thickness of 8.5 mm. The three layers were stretch formed simultaneously in a 48 minute cycle time at forming temperatures like those specified above for the sideframe panel.

Figure 4:
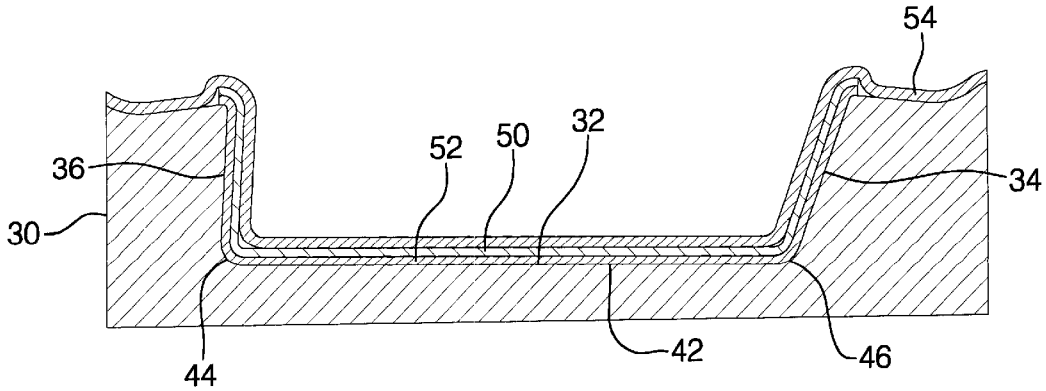
FIG. 4 is a cross-sectional view of the formed three sheet layers in the tool viewed in direction 4—4 indicated in FIG. 3.

FIG. 4 is a cross-sectional view of the tool 30 and three layer formed pocket piece (i.e., main sheet 54 and patch sheets 50 and 52). The pieces were formed simultaneously but did not become bonded during the forming process. The view in FIG. 4 is taken in the direction 4—4 shown in FIG. 3. The bottom 42 of the formed pocket-shaped piece is flat and the corners 44 and 46 sharp. Despite the severity of the forming operation, the three pieces, totaling over 8 mm in thickness, were deformed without difficulty.

In an effort to speed the forming of the three pieces, a similar three layer set of main part layer and double, 2.5 mm thick patches formed under the same pressure conditions, but terminated after 20 minutes, failed to fully form the bottom corner radii 44, 46 of the pocket.

This invention thus provides a very useful option for the stretch forming of sheets of pseudo-single-phase superplastic metal alloys. When a thickness exceeding about 2 mm is required for a part that must undergo substantial deformation, it is now possible to form the part with a plurality of stacked thinner sheets. Depending upon the shape and thickness requirements of the part to be formed, the sheets may or may not be of identical shape or thickness. A stack of sheets may be spot welded or otherwise joined to facilitate handling during the superplastic forming process in which they are simultaneously shaped, but preferably they are formed without becoming diffusion bonded during the forming process itself. Final joining of the sheets, if required, is accomplished after the SPF process. In this way, a thicker, more defect-free SPF part can be often be formed with shorter processing time.

In other embodiments of the invention, a stack of simultaneously formable SPF sheets can be used to accomplish different results. For example, two or more nesting sheets of closely similar shape can be formed for use in separate applications. Alternatively, a stack of nested sheet parts can be separated and inverted for attachment as a symmetrical box or channel section or the like. In still another embodiment, the stack of sheets for forming may comprise a main part layer with additional separable sheet layers intended for patching or reinforcing application on the main sheet layer. Separate layers simultaneously formed in this manner will closely fit the adjoining portion of the main layer. If desired, for example, relatively small reinforcing sheet sections can be cut out or trimmed, if necessary, from the reinforcing sheet for locating on and bonding to the main sheet part.

Obviously, this practice of simultaneously forming a stack of separate SPF sheets lends itself to many useful and beneficial applications.

What is claimed is:

1. A method for superplastic forming of a sheet metal product by permanent deformation of sheet stock of superplastic metal alloy, said method comprising forming a stack comp ising two or more individual sheets of cold-rolled superplastic aluminum metal alloy material, heating the stacked sheets to their superplastic forming condition, forming said stacked sheets as a unit into a nested configuration of a half section of a desired article having a cross-sectional plane of symmetry without forming diffusion bonds between said sheets, separating said sheets, and assembling them in the full cross section of said article.

2. A method as recited in claim 1 in which said sheets are cold-rolled aluminum alloy sheets characterized by a fine grained microstructure providing said superplastic property.

3. A method as recited in claim 1 which said sheets are cold-rolled aluminum alloy sheets comprising up to about six percent by weight magnesium and characterized by a fine grained microstructure providing said superplastic property.

4. A method as recited in claim 1 in which the thickness of said sheets is less than about two millimeters.

* * * * *